US006149471A

United States Patent [19]

Kemp et al.

[11] Patent Number: 6,149,471

[45] Date of Patent: Nov. 21, 2000

[54] ARROWHEAD RETENTION FEATURE FOR A TERMINAL PIN

[75] Inventors: Adam M. Kemp, Youngstown; John Wicks, Cortland, both of Ohio

[73] Assignees: General Motors Corporation, Detroit, Mich.; Packard Hughes Interconnect Company, Irvine, Calif.

[21] Appl. No.: 09/121,371

[22] Filed: Jul. 23, 1998

[51] Int. Cl.[7] ..... H01R 13/40

[52] U.S. Cl. ..... 439/733.1; 439/869; 439/444

[58] Field of Search ..... 439/733.1, 869, 439/444, 751, 631

[56] References Cited

U.S. PATENT DOCUMENTS

| | | | |
|---|---|---|---|
| 3,533,054 | 10/1970 | Spriggs et al. | 439/733.1 |
| 3,579,178 | 5/1971 | Travis | 439/733.1 |
| 3,754,203 | 8/1973 | Pauza et al. | 439/733.1 |
| 4,698,026 | 10/1987 | Rolf | 439/751 |
| 4,804,339 | 2/1989 | Cohen | 439/588 |
| 4,867,690 | 9/1989 | Thumma | 439/631 |
| 5,035,656 | 7/1991 | Patel | 439/733.1 |
| 5,286,218 | 2/1994 | Sakurai et al. | 439/733.1 |

*Primary Examiner*—Paula Bradley
*Assistant Examiner*—Katrina Davis
*Attorney, Agent, or Firm*—Richard A. Jones

[57] ABSTRACT

A terminal retention feature for retaining a terminal pin in a terminal block is disclosed. The retention feature includes an arrowhead shape having barbs thereon. The barbs are tapered on the front side to reduce insertion forces and eliminate deformation of the terminal block. The retention feature provides reduced insertion forces while enabling high retention forces preventing pull out of the terminal pin.

5 Claims, 1 Drawing Sheet

ARROWHEAD RETENTION FEATURE FOR A TERMINAL PIN

TECHNICAL FIELD

The present invention relates generally to terminal pins for electrical connectors and, more particularly, to an arrowhead type retention feature for retaining a terminal pin in a terminal block of an electrical connector.

BACKGROUND OF THE INVENTION

Several designs have been used in the past to connect a terminal pin to a terminal block for an electrical connector. These designs include a star design that has a plurality of outwardly extending ribs on the body of the terminal pin. The ribs engage the sides of a socket in the terminal block to hold the terminal pin in place. The position of a terminal pin having a star shaped retention feature in the terminal block is difficult to control within a close tolerance.

Another design is a blade type. The blade type includes a flat section extending outward of the pin shaft. The sides of the flat section extend outwardly in opposite directions and engage the sides of the socket formed in the terminal block.

Although such retention features have worked in the past, they suffer a disadvantage in that they are sometimes inadequate for assembly and retention. Further such designs have limitations in the amount of retention force that can be generated as increasing the size of the star or blade type results in deformation of the socket located in the terminal block.

SUMMARY OF THE INVENTION

Accordingly, the present invention is a terminal pin having a retention feature for retaining a terminal pin in a terminal block. The retention feature including a plurality of barbs. The barbs are tapered on a lead in side to reduce an insertion force and eliminate plastic push out or deformation of the socket on the terminal block. The terminal pin further includes center ribs adjacent the barbs to maintain rigidity of the terminal pin and reduce buckling during insertion into the terminal block. A further feature of the present invention includes a shoulder adjacent the barbs that allows for alternative assembly methods.

The present invention further includes a method for manufacturing an article wherein a retention feature is stamped on a blank terminal pin. Such a method provides smooth edges adjacent the barbs to reduce insertion forces.

Other features and advantages of the present invention will be readily appreciated as the same becomes better understood after reading the subsequent description when considered in connection with the accompanying drawings.

DESCRIPTION OF THE PREFERRED EMBODIMENT

Figure 1:
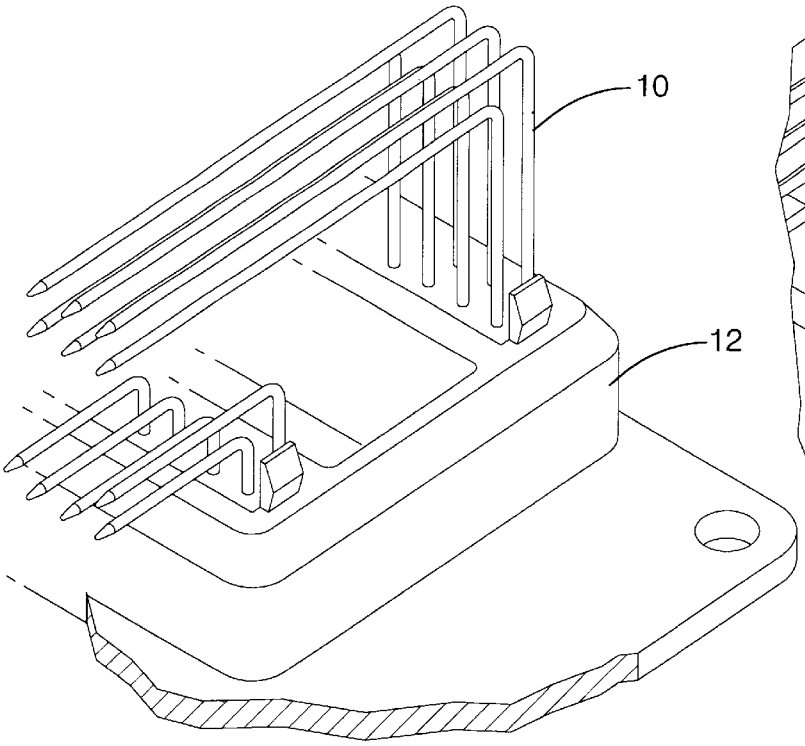
FIG. 1 is a perspective view of a plurality of terminal pins having a retention feature, according to the present invention, inserted into a terminal block.
Figure 2:
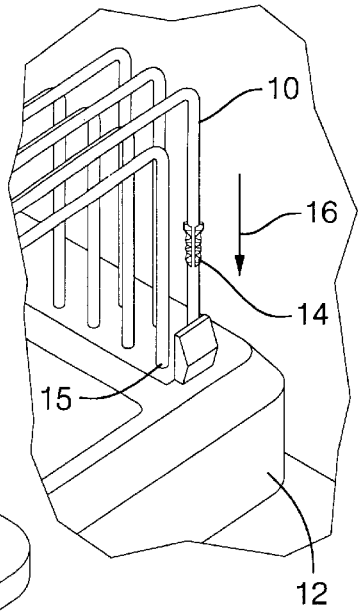
FIG. 2 is a view similar to that shown in FIG. 1 showing a terminal pin having a retention feature, according to the present invention prior to inserting the terminal pin in the terminal block.

Referring to FIGS. 1 and 2, one embodiment of a plurality of terminal pins 10 are shown positioned in a terminal block

12. The terminal pins 10 are typically held within the terminal block 12 by a retention feature 14, according to the present invention. As shown in FIG. 2, the terminal pin 10 is inserted into a socket 15 in the terminal block 12 in the direction shown by the arrow 16. The terminal pin 10 is pushed in the direction of the arrow 16 until the retention feature 14 enters the socket 15 and is fully seated within the terminal block 12.

Figure 3:
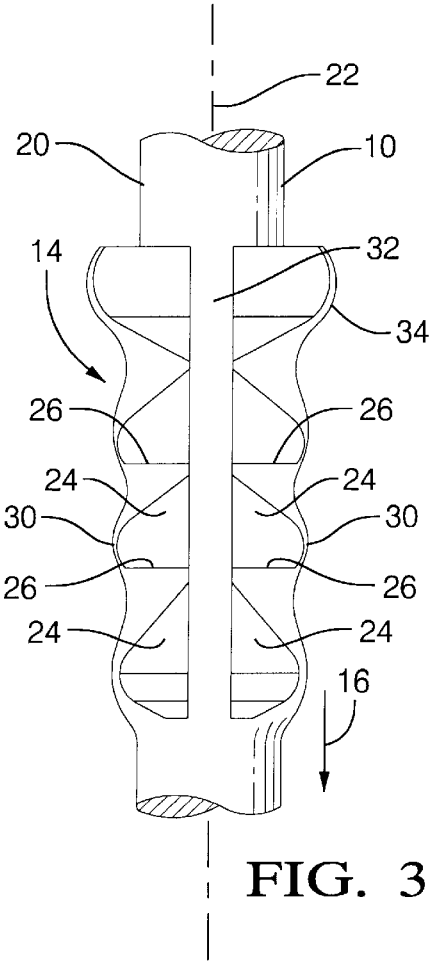
FIG. 3 is an enlarged front view of the terminal pin having the retention feature of FIG. 2.
Figure 4:
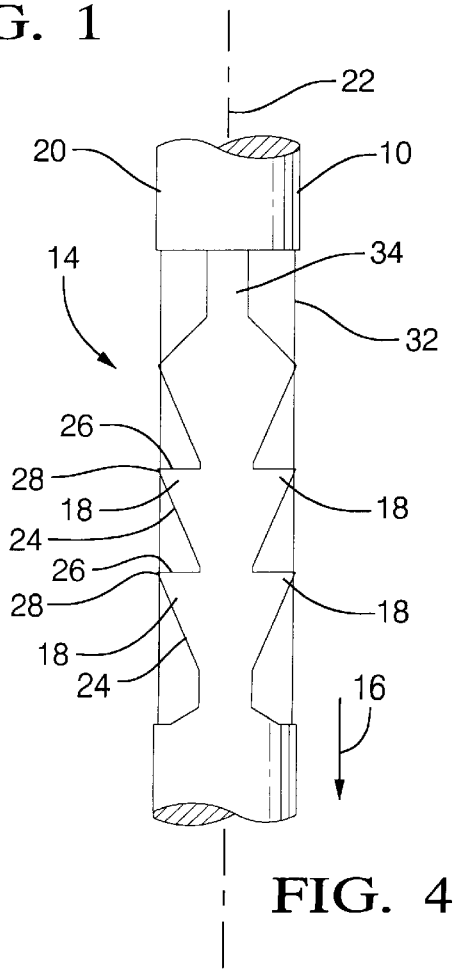
FIG. 4 is a side view of the retention feature as shown in FIG. 3.

Referring to FIGS. 3 and 4, the retention feature 14 of the terminal pin 10 is illustrated. The retention feature 14 includes a plurality of barbs 18 located on the terminal pin 10. As shown, the terminal pin 10 is an elongated cylindrical member 20 having a longitudinal axis 22 and a generally circular cross-sectional shape. The barbs 18 include an inclined surface 24 and a flat surface 26. The inclined surface 24 and the flat surface 26 come together to form an edge 28. The edge 28 engages side walls (not shown) of the socket 15 located on the terminal block 12 when the terminal pin 10 is inserted into the terminal block 12.

As illustrated in FIG. 3, an outer surface 30 of the retention feature 14 is smooth and includes a plurality of undulations along the cylindrical member. During insertion of the terminal pin 10 into the terminal block 12, the outer surface 30 cooperates with the inclined surfaces 24 to facilitate insertion of the terminal pin 10 into the terminal block 12 by reducing the force required to insert the terminal pin 10 into the terminal block 12. The retention feature 14 further includes a center rib 32 extending along the length of the retention feature 14. As illustrated in FIG. 4, the center rib 32 extends adjacent the barbs 18 on both sides of the terminal pin 10. The center ribs 32 assist in maintaining the rigidity of the cylindrical member 20 to prevent buckling of the terminal pin 10 during insertion into the terminal block 12.

The retention feature 14 includes a shoulder 34 extending radially outwardly from the longitudinal axis 22. The shoulder 34 is of a size greater than the socket 15 in the terminal block 12 into which the terminal pin 10 is inserted. The shoulder 34 assists in properly positioning the depth of the terminal pin 10 in the terminal block 12. For example, the terminal pin 10 is pushed into the terminal block 12 until the shoulder 34 engages the terminal block 12 preventing further insertion. The shoulder 34 also allows for alternative methods of installation. For example, the prior art required a tool to push in and properly locate the depth of the terminal pin 10. Since the shoulder 34 is of a size greater than the aperture in the terminal block 12, the shoulder 34 acts as a stop to properly locate the position of the terminal pin 10 thus eliminating the need for a tool to properly position the terminal pin 10 within the terminal block 12.

The present invention further includes a unique method for forming the retention feature 14 of the terminal pin 10. The method manufactures the retention feature 14 through a stamping process. The stamping process is used instead of a shearing process to eliminate burrs and provide the smooth outer surface 30 that facilitates installation. During the stamping process, a die (not shown) having opposite halves, each half having a configuration that is the mirror image of the inclined and flat surfaces 24 and 26, respectively, is used. The die contains a relief portion corresponding to the center rib 32. The shape of the die will not be further discussed as it is apparent to those reasonably skilled in the art that the use of stamping dies to obtain particular shapes is well know. During the stamping process, the die contacts the cylindrical member 20. As the die engages the cylindrical member 20, it deforms the cylindrical member 20 by displacing the material forming the cylindrical member 20 outward away from the longitudinal axis 22. As the material of the cylindrical member 20 is urged outward, it forms the barbs 18 along with the smooth outer surface 30. Thus, the material of the cylindrical member 20 is not constrained within the die but is allowed to flow outward, thus developing the smooth outer surface 30. Further, as illustrated in FIGS. 3 and 4, the material adjacent the center rib 32 is also displaced to form the shoulder 34. Forming the retention feature 14 in this manner eliminates the burrs associated with a shear process and provides a smooth outer surface 30. Such a process results in a retention feature 14 having barbs 18 which provide high retention forces compared to previous type designs. Such a design also provides for reduced insertion forces, thus facilitating entry of the terminal pin 10 into the terminal block 12.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A terminal pin comprising:

an elongated cylindrical member having a longitudinal axis;

a plurality of barbs formed on and extending longitudinally along said cylindrical member and a smooth outer surface adjacent said barbs having a plurality of continous undulations along said cylindrical member, each of said barbs including an inclined surface extending outwardly from said longitudinal axis and terminating at said outer surface to reduce an insertion force of said terminal pin, each of said barbs including a flat surface coming together with said inclined surface to form an edge;

a shoulder positioned adjacent said barbs and extending radially outwardly from said longitudinal axis a distance greater than said barbs to position a depth of the terminal pin when inserted; and a center rib on said cylindrical member adjacent to said barbs and extending longitudinally along said cylindrical member a length of said barbs to maintain a rigidity of said terminal pin.

2. A method for manufacturing a retaining feature on a terminal pin including the steps of:

providing a terminal pin being a cylindrical member;

utilizing a stamping process to form a retention feature having a plurality of barbs each with an inclined surface and a flat surface terminating at an outer surface on the cylindrical member wherein said stamping process includes the step of allowing the material of the cylindrical member to be outwardly displaced to form the outer surface smooth with a plurality of continuous undulations along the cylindrical member on opposite sides of the terminal pin; and forming a shoulder on said terminal pin to extend radially outwardly from the cylindrical member a distance greater than the barbs to position a depth of the terminal pin when inserted.

3. A method as set forth in claim 2 wherein the step of utilizing a stamping process to form the retention feature includes the step of forming a center rib on the terminal pin at the same time as the retention feature is formed.

4. A method as set forth in claim 2 wherein the step of utilizing a stamping process to form the retention feature includes the step of forming the barb on said terminal pin and the step of forming a center rib on said terminal pin adjacent said barb.

5. A method as set forth in claim 4 wherein the step of forming said barb and the step of forming said center rib are accomplished simultaneously.

* * * * *